US008184842B2

(12) United States Patent
Howard et al.

(10) Patent No.: US 8,184,842 B2
(45) Date of Patent: May 22, 2012

(54) TOOL FOR INSERTION AND REMOVAL OF IN-CANAL HEARING DEVICES

(75) Inventors: Robert Howard, Palo Alto, CA (US); Evelyne Chaubert, San Francisco, CA (US); Gretchen Anderson, Oakland, CA (US); Jonathan Paul Downing, Belmont, CA (US); Nicholas Hausman, San Francisco, CA (US); Janet Karen Hwu, San Diego, CA (US); Ricardo Penate, Pacifica, CA (US)

(73) Assignee: InSound Medical, Inc., Newark, CA (US)

( * ) Notice: Subject to any disclaimer, the term of this patent is extended or adjusted under 35 U.S.C. 154(b) by 474 days.

(21) Appl. No.: 12/408,439

(22) Filed: Mar. 20, 2009

(65) Prior Publication Data

US 2010/0239112 A1 Sep. 23, 2010

(51) Int. Cl.
*H04R 25/00* (2006.01)

(52) U.S. Cl. ..... 381/329; 381/324; 381/328; 381/380; 181/129; 181/135

(58) Field of Classification Search ..... 181/128, 181/129, 135; 381/322, 324, 325, 328, 329, 381/380
See application file for complete search history.

(56) References Cited

U.S. PATENT DOCUMENTS

| | | | | |
|---|---|---|---|---|
| 3,890,474 | A * | 6/1975 | Glicksberg | 381/72 |
| 4,133,984 | A * | 1/1979 | Akiyama | 381/328 |
| 4,817,609 | A | 4/1989 | Perkins et al. | |
| 6,094,494 | A * | 7/2000 | Haroldson | 381/328 |
| 6,256,396 | B1 * | 7/2001 | Cushman | 381/328 |
| 6,473,513 | B1 | 10/2002 | Shennib et al. | |
| 6,724,902 | B1 * | 4/2004 | Shennib et al. | 381/328 |
| D509,054 | S | 9/2005 | Shennib et al. | |
| 6,940,988 | B1 | 9/2005 | Shennib et al. | |
| 7,298,857 | B2 | 11/2007 | Shennib et al. | |
| 7,379,555 | B2 | 5/2008 | Gable et al. | |
| 7,388,961 | B2 | 6/2008 | Shennib et al. | |
| 7,551,747 | B2 | 6/2009 | Huynh et al. | |
| 7,913,696 | B2 * | 3/2011 | Purcell et al. | 128/864 |
| 2005/0249370 | A1 * | 11/2005 | Shennib et al. | 381/329 |
| 2008/0144871 | A1 * | 6/2008 | Purcell et al. | 381/329 |
| 2010/0142739 | A1 * | 6/2010 | Schindler | 381/329 |

OTHER PUBLICATIONS

Ballachanda, The Human Ear Canal, Singular Publishing, 1950, pp. 195.

* cited by examiner

*Primary Examiner* — Allan R Wilson
(74) *Attorney, Agent, or Firm* — Henricks, Slavin & Holmes LLP

(57) ABSTRACT

Methods, tools, and methods of manufacturing said tools are provided for inserting a hearing device deeply into the ear canal of a user and adjusting its medial-lateral position therein. The provided tools comprise a shaft. A distal end of the shaft can be coupled to the hearing device. The shaft is flexible to facilitate its insertion into the tortuous ear canal and minimize injurious contact with the ear canal. The length of the shaft can be adjusted to adjust the depth of insertion of the shaft into the ear canal, customizing the tool for an individual user. Medial advancement of the shaft into the ear canal is limited by a base, side extension, or mold coupled to a proximal portion of the shaft or other proximal part of the tool.

12 Claims, 12 Drawing Sheets

TOOL FOR INSERTION AND REMOVAL OF IN-CANAL HEARING DEVICES

BACKGROUND OF THE INVENTION

1. Field of the Invention

Embodiments of the present invention relate to tools and methods for inserting, adjusting the position of hearing devices worn in the ear canal, particularly the medial-lateral position of hearing devices worn deep in the ear canal, and removing devices.

Since embodiments of the invention relate to adjusting the position of a hearing device from the ear canal, a brief description of the anatomy of the ear canal will now be presented for purposes of illustration. While the shape and structure, or morphology, of the ear canal can vary from person to person, certain characteristics are common to all individuals. Referring now to FIGS. 1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum), although the length of the ear canal can vary from person to person. The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, chewing, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony regions 13. The magnitude of the angle of this bend and the depth into the ear canal at which the bend is located varies among individuals.

The ear canal 10 terminates medially with the tympanic membrane 18. Laterally and external to the ear canal 10 is the concha cavity 2 and the auricle 3, both also cartilaginous. The concha cavity 2 defines a conchal bowl. The junction between the concha cavity 2 and the cartilaginous part 11 of the ear canal 10 at the aperture 17 is defined by a characteristic bend 12 known as the first bend of the ear canal. The magnitude of the bend angle and other dimensions of the characteristic bend 12 can vary among individuals. Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal 10. Canal debris is naturally extruded to the outside of the ear by the process of lateral epithelial cell migration (see e.g., Ballachanda, The Human ear Canal, Singular Publishing, 1995, pp. 195). There is no cerumen production or hair in the bony part of the ear canal. The ear is sensitive to pressure and touch, often moreso in the bony part of the canal. Sensitivity also varies among individuals. It is hypothesized that for every individual, there could be an optimal placement of a deep in the canal device that maximizes the probability of a comfortable and effective fit.

FIG. 2 shows a cross-sectional view of the typical ear canal 10 and reveals generally an oval shape and pointed inferiorly (lower side). The long diameter ($D_L$) is along the vertical axis and the short diameter ($D_S$) is along the horizontal axis. These dimensions vary among individuals.

Recently, Completely-In-The-Canal (CIC) hearing devices have come into greater use. These devices fit deep within the ear canal and can be essentially hidden from view from the outside, providing a cosmetic advantage over larger, externally mounted hearing devices. Placing the hearing device deep within the ear canal and proximate to the tympanic membrane (ear drum) also improves the frequency response of the device, reduces distortion due to jaw extrusion, reduces the occurrence of the occlusion effect and improves overall sound fidelity. The degree of proximity of the hearing device to the tympanic membrane can vary among individuals, for example, depending on the comfort of the user.

However, despite their advantages, CIC hearing devices, particularly those positioned deep in the ear, are not as readily accessible by the user as are ITC devices. CIC hearing devices typically require insertion, removal, and positioning by a skilled professional, e.g., an ear, nose and throat specialist (ENT) or an audiologist, and/or access to specialized equipment. Even when inserted by a professional, there is a need for tools that simplify the insertion process to both speed it up, reducing the time the professional must spend, and also to standardize outcome, reducing the variability inherent in the distribution of practitioner skill. Furthermore, a user of a CIC hearing device may not always have proximity to a professional or access to equipment readily available. Therefore, simple and effective methods and tools for a user to introduce, position, reposition and/or remove a CIC hearing device are desired. Moreover, as the size and shape of the ear canal can vary between individuals, the optimal location for placement and optimal orientation of a CIC hearing device can vary between individuals as well. It is further desirable for such methods and tools to be customizable for individual users.

2. Description of the Background Art

Applicants are aware of co-pending application Ser. No. 61/119,971, filed on Dec. 4 2008 in the name of Robert Schindler. The aforementioned application in the name of Robert Schindler, however, does not appreciate the variability of the ear canal between individuals. As such, insertion of a hearing device to a fixed depth is taught while adjustment of the position and orientation of the hearing device within the hearing canal is not taught. U.S. patents which may be of interest may include U.S. Pat. Nos. 3,890,474; 7,388,961; and D509,054, the entire contents of which are incorporated herein by references.

BRIEF SUMMARY OF THE INVENTION

Various embodiments of the invention provide methods, tools, and methods of manufacturing such tools for inserting a hearing aid deeply into the ear canal of a user and adjusting the medial-lateral position of the hearing aid therein. Also, those and other embodiments may allow the hearing device to be removed by the user or by another person (e.g. a doctor or audiologist). Advantageously, such embodiments allow the position and/or orientation of the hearing device to be adjusted with minimal dexterity by the user and with minimal visualization of either the ear or the tool by the user.

In a first aspect, embodiments of the invention provide a tool for inserting a hearing device within an ear canal of a user. The tool comprises a base and a shaft. The base has a proximal receptacle for receiving a user's finger. The base also has a distal end adapted to engage a wall of a conchal bowl of an ear of the user. The distal end of the base limits medial advancement of the tool. The shaft has a lateral end and a medial end. The lateral end is coupled to the distal end of the base. The medial end is adapted to capture the hearing device. The shaft has an adjustable length which can be customized for an individual user.

In many embodiments, the distal end of the base may be shaped to conform to the conchal bowl. In many embodiments, the distal end of the base may comprise an engagement member. The engagement member is adapted to engage a wall of the conchal bowl to limit medial advancement of the tool. The engagement member is separable from the base. In some embodiments, the engagement member comprises a mold shaped to conform to the conchal bowl. The mold may be made of a material comprising at least one of silicone, clay, quick-dry gel, or similar malleable materials.

The shaft may comprise a series of shaft portions which are detachable from one another. The length of the shaft may thereby be adjusted be attaching or detaching these shaft portions from each other. The shaft will typically be flexible to facilitate insertion into the tortuous ear canal and minimize injurious contact therein.

In another aspect, embodiments of the invention provide a method for assembling a tool for inserting a hearing device within an ear canal of a user. The distance between the hearing device and a conchal bowl of an ear of the user is measured. The length of a shaft of the tool is adjusted based on the measured distance.

In many embodiments, a mold is conformed to the shape of the conchal bowl, and the adjusted shaft is coupled to the distal end of the base of the tool and to the conformed mold.

In many embodiments, the shaft comprises a plurality of detachable shaft portions. The length of the shaft may be adjusted by attaching or detaching at least one shaft portion from the shaft.

In another aspect, embodiments of the invention provide a method for using a tool to insert a hearing device within an ear canal of a user. The hearing aid is coupled to a distal end of a shaft of the tool. The shaft and the coupled hearing device are inserted into the ear canal. Medial advancement of the shaft is limited by a distal end of a base of the tool engaging a wall of a conchal bowl of the user.

In many embodiments, the method further comprises inserting a finger of the user into a proximal receptacle of the base of the tool.

In many embodiments, the method further comprises adjusting the length of the shaft.

In many embodiments, the shaft comprises a plurality of detachable shaft portions. The length of the shaft may be adjusted by attaching or detaching at least one shaft portion from the shaft.

In another aspect, embodiments of the invention provide a tool for adjusting the positioning, for example, the medial-lateral and/or rotational positioning, of a hearing device placed within an ear canal of a user. The tool comprises an outer sheath, a side extension, a plunger, a shaft, and a cap. The side extension extends out of an outer wall of the outer sheath and is adapted to abut a wall of a conchal bowl of an ear of the user when the tool is inserted into the user's ear canal. The plunger is axially moveable and received within the outer sheath. The shaft has a distal end and a proximal end coupled to a distal end of the plunger. The shaft has an adjustable length. The cap is axially moveable and mounted over a distal portion of the shaft. The cap is adapted to capture the hearing device. A distal end of the shaft abuts the hearing device when the hearing device is captured by the cap.

In many embodiments, the tool further comprises a string coupled to the cap and leading out of a proximal end of the plunger. Proximal retraction of the string proximally retracts the cap to release a captured hearing device.

In many embodiments, the shaft may comprise a plurality of shaft portions removable from one another.

In many embodiments, the shaft is flexible to facilitate insertion into the tortuous ear canal and minimize injurious contact therein.

In many embodiments, the side extension is adapted to conform to the shape of the conchal bowl.

In many embodiments, the tool may be used to adjust the position, for example, the medial-lateral and/or rotational position, of a hearing device placed within an ear canal of a user. The tool is advanced medially against the ear of the user until the side extension restricts further medial advancement. The distal shaft is advanced into the ear canal by pushing the plunger medially. The hearing device is captured with the cap. The plunger is axially moved relative to the outer sheath to adjust the medial-lateral position of the captured hearing device within the ear canal.

In another aspect, embodiments of the invention provide a tool for adjusting the positioning, for example, the medial-lateral and/or rotational positioning, of a hearing device placed within an ear canal of a user. The tool comprises a tube, a loop, a shaft, and a rest. The tube has a proximal end, a distal end adapted to capture the hearing device, and a side aperture having an adjustable length. The loop is for receiving a finger of a user and is coupled to the proximal end of the tube. The shaft is axially moveable and disposed within the tube. A distal portion of the shaft is adapted to abut the hearing device when the hearing device is captured by the distal end of the tube. The rest is for resting against a cheek of a user. The rest is coupled to a proximal portion of the first shaft and extends radially out of the side aperture of the tube. A portion of the rest is laterally abutted by an edge of the portion of the tube defining the side aperture. Pulling the tube in a lateral direction relative to the shaft causes the distal end of the tube to release the hearing device. Adjusting the length of the side aperture adjusts the axial position of the rest and the shaft within the tube.

In many embodiments, the shaft is spring-loaded within the tube and biased to retract proximally relative to the tube.

In many embodiments, the shaft and the tube are flexible to facilitate insertion of the tool into the tortuous ear canal and minimize injurious contact therein.

In another aspect, embodiments of the invention provide a tool for adjusting the positioning, for example, the medial-lateral and/or rotational positioning, of a hearing device placed within an ear canal of a user. The tool comprises a pressable proximal portion, a distal portion, and a distal tip. The distal portion is coupled to the pressable proximal portion and has a profile sized for insertion into the ear canal. The distal tip captures a lateral end of the hearing device. Pressing the proximal pressing portion expands the distal tip to release a captured hearing device. Rotating the tool about its longitudinal axis may rotate the captured hearing device, for example, when the hearing device is captured within an ear canal of a user.

In many embodiments, the tool comprises a pair of reverse-action tweezers.

In many embodiments, the distal portion comprises a side extension adapted to adapted to engage a wall of a conchal bowl of an ear of the user. The side extension limits medial advancement of the tool. The side extension may be shaped to conform to the conchal bowl. The distal portion may be flexible to facilitate its insertion into the tortuous ear canal and minimize injurious contact therein.

In another aspect, embodiments of the invention provide a tool for adjusting the positioning, for example, the medial-lateral and/or rotational positioning, of a hearing device placed within an ear canal of a user. The system comprises a rod and a mold. The rod has a proximal portion for handling by the user, a distal portion, and a distal end adapted to capture the hearing device. The mold is coupled to the distal portion of the rod. The mold is adapted to limit medial advancement of the rod into the ear canal. The mold may also be shaped to conform to a conchal bowl of an ear of the user. At least a distal portion of the rod may be flexible to facilitate insertion of the tool into the tortuous ear canal and minimize injurious contact therein.

DETAILED DESCRIPTION OF THE INVENTION

Figure 1:
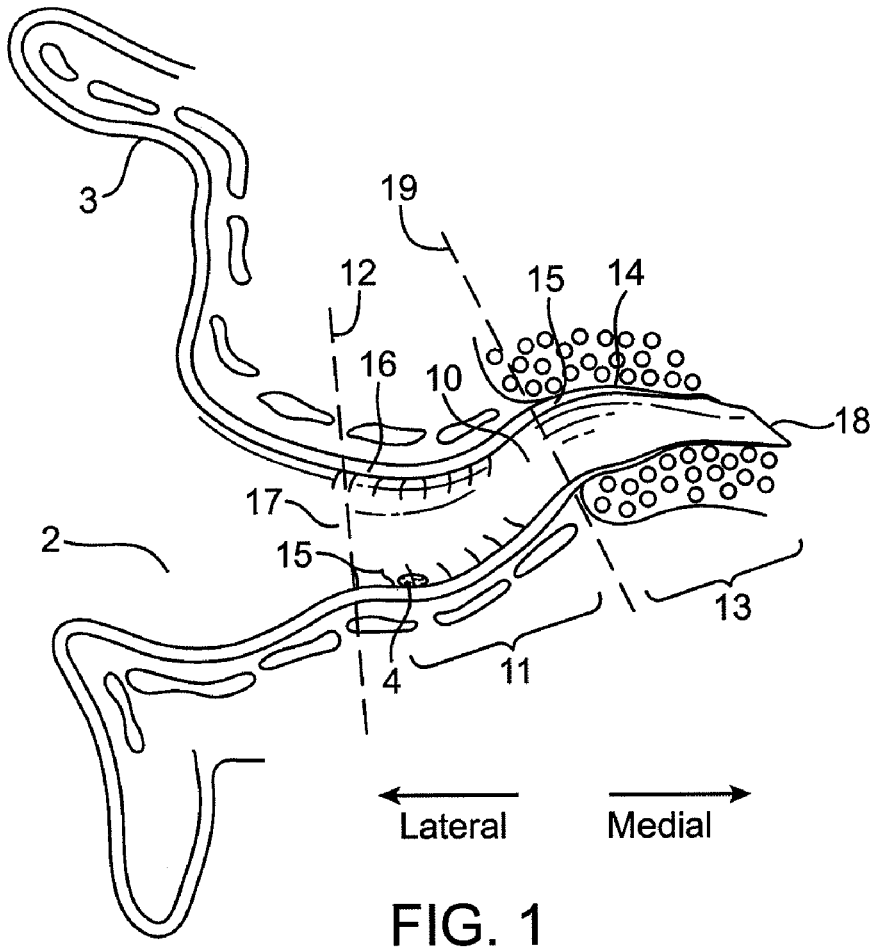
FIG. 1 is a side coronal view of the external ear canal.
Figure 2:
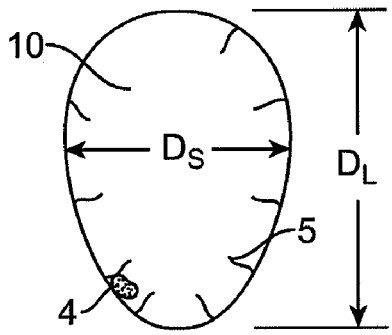
FIG. 2 is a cross-sectional view of the ear canal in the cartilaginous region.
Figure 3:
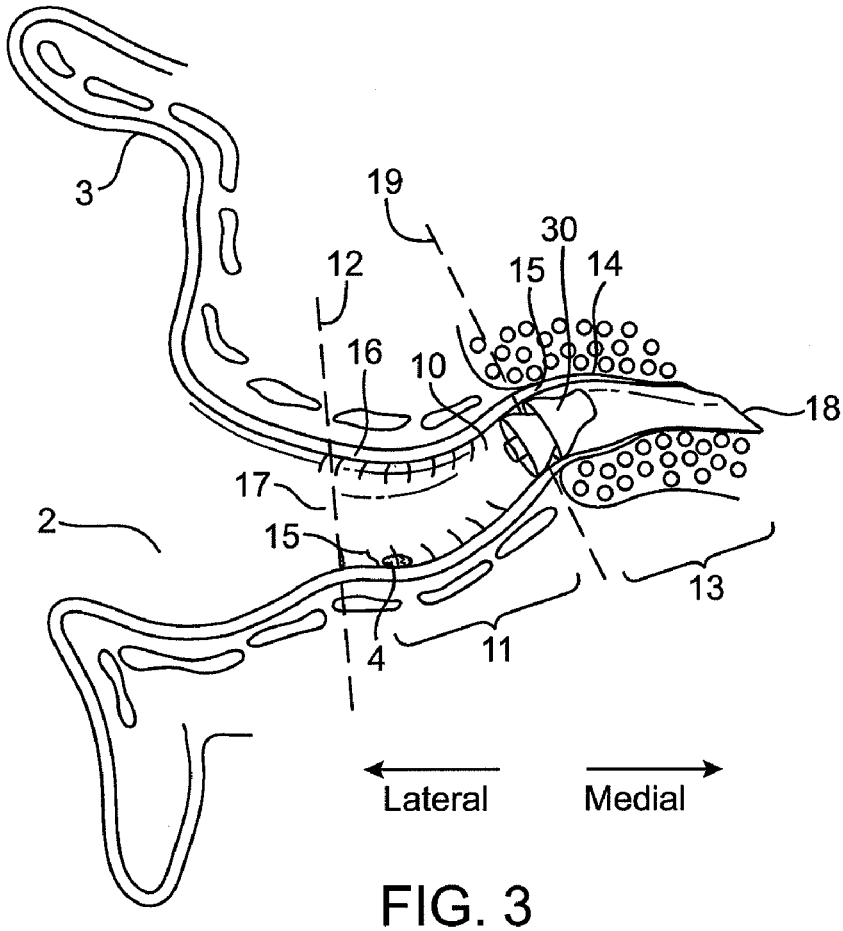
FIG. 3 is a side coronal view of the external ear canal with an in-canal hearing device positioned within.

Referring now to FIG. 3, a side coronal view of the ear canal 10 with an in-canal hearing device 30 is shown. In-canal hearing device 30 will typically be designed to be positioned within the ear canal 10 at about the characteristic bend 15 at the bony junction 19.

Figure 3A:
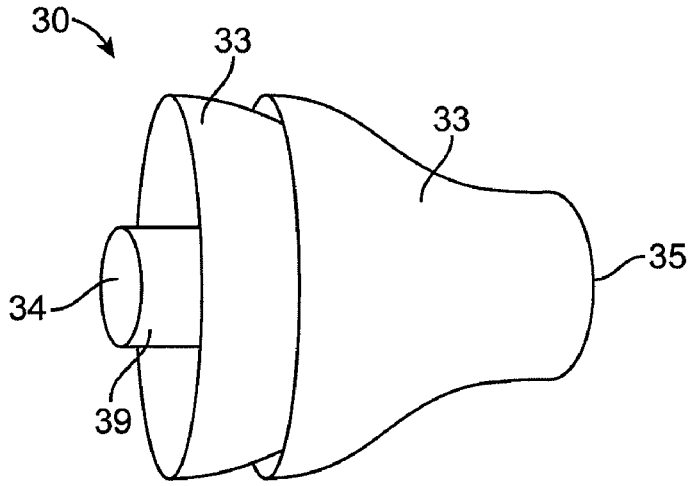
FIG. 3A shows the in-canal hearing device of FIG. 3.

FIG. 3A shows a side view of in-canal hearing device 30. In-canal hearing device 30 may comprise seals 33, a lateral end 34, and a medial end 36. The lateral end 34 comprises a lateral knob 39.

Embodiments of the invention typically provide tools and methods for adjusting the position of hearing devices worn in the ear canal. Under the supervision of a professional, the hearing aid 30 may be placed at an optimum position and/or orientation within the ear canal, e.g., at the bony junction 19. In at least some instances, the hearing device 30 may deviate from the position and/or orientation or may require removal, for example, using the tools described in co-assigned U.S. Pat. Nos. 7,388,961 and D509,054. The tools described herein will typically find use in reinserting the hearing aid 30 to its optimum position and/or orientation when a professional is not readily available.

Figure 4:
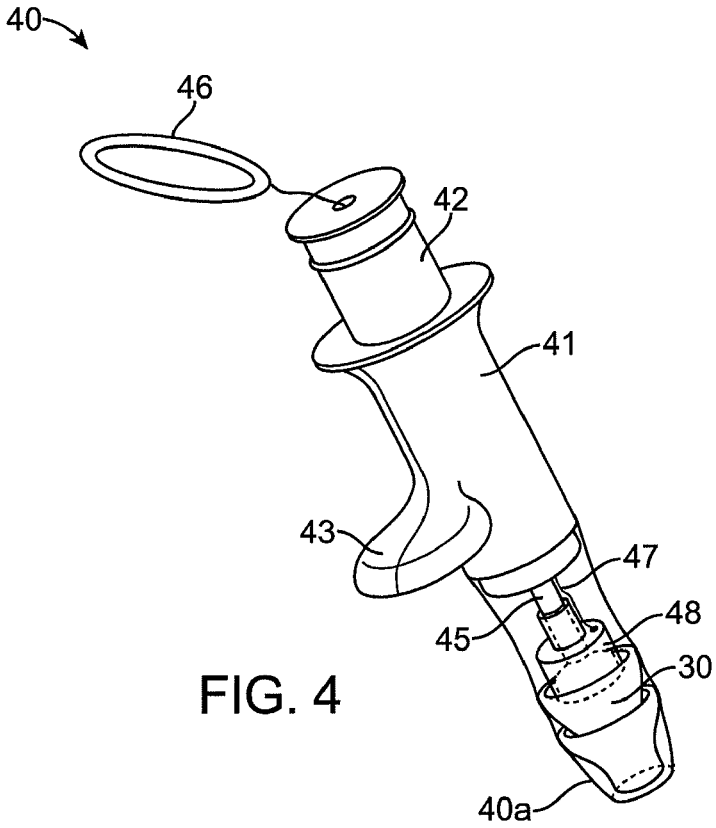
FIG. 4 is a perspective view of a syringe adapted for positioning an in-canal hearing device.

FIG. 4 shows a syringe 40 adapted for inserting and/or positioning the in-canal hearing device 30 within a user's ear canal. The syringe 40 comprises a distal tip 41*a*, an outer sheath 41 and a plunger 42. The outer sheath 41 comprises a side extension 43. The plunger 42 has a distal end 42*a* and a proximal end 42*b*. The plunger 42 comprises a distal shaft 45, a ring 46, a tether 47, and a distal cap 48.

Figure 4A:
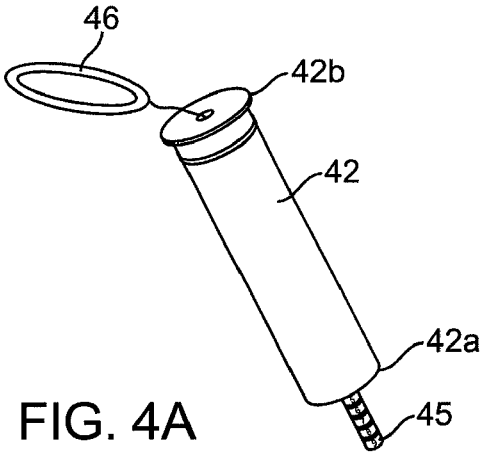
FIG. 4A is a perspective view of a plunger of the syringe of FIG. 4.

As shown in FIG. 4A, the plunger 42 comprises a distal end 42*a* and a proximal end 42*b*. A shaft 45 is coupled to the distal end 42*a*. As shown in FIG. 4, the distal cap 48 may be mounted over the shaft 45. The distal cap 48 is configured to capture the lateral knob 39 of the hearing device 30. When the hearing device 30 is captured, the distal end of the shaft 45 abuts the lateral knob 39 of the hearing device 30. The distal cap 48 is linked to ring 46 by the tether 47, which traverses the interior of plunger 42 and exits out of its proximal end 42*b*. Pulling the ring 47 releases a captured hearing device 30. By pulling the ring 47, the distal cap 48 is moved in a proximal direction while the distal end of the shaft 45 remains abutting the hearing device 30. This action of distal cap 48 and shaft 45 causes the distal cap 48 to release the lateral knob 39.

Figure 4B:
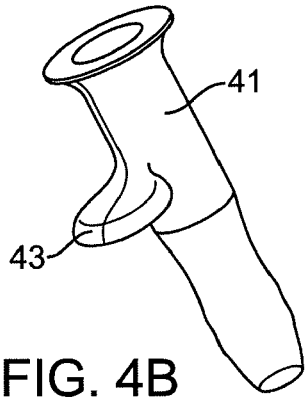
FIG. 4B is a perspective view of an outer sheath of the syringe of FIG. 4.

As shown in FIG. 4B, the outer sheath 41 comprises a side extension 43. The side extension 43 may be shaped to conform with the conchal bowl of a user, e.g., the side extension 43 may comprise a mold. The side extension 43 limits medial advancement of the syringe 40 as the distal tip 40*a* of the syringe is inserted into the ear canal.

Figure 4C:
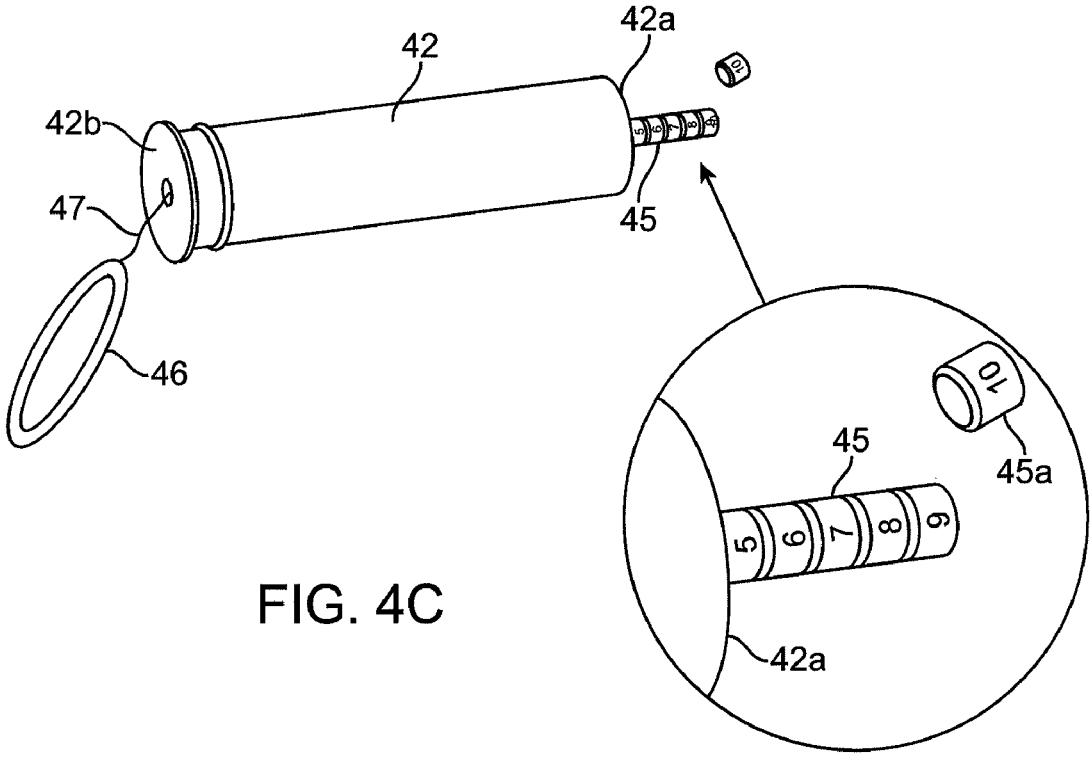
FIG. 4C shows a magnified view of a tip of the plunger of FIG. 4A.

FIG. 4C shows a magnified view of the distal end 42*a* of the plunger 42, including the shaft 45. The shaft 45 will typically be flexible. When inserted into the ear canal 10, the flexibility of the shaft 45 allows it to accommodate for the tortuous passage of the ear canal 10 and minimize injurious contact with the walls of the ear canal. The shaft 45 are typically adjustable in length. For example, the shaft 45 may comprise a plurality of shaft portions 45*a* which are removable from each other. The length of shaft 45 is generally adjusted to set the maximum insertion depth of hearing device 30. For example, a professional may measure the ideal ear canal insertion depth of the in-canal hearing aid 30 and set the length of the shaft 45 accordingly. A customized syringe 40 is thus provided to a user for use by the user to adjust the medial-lateral position of his or her hearing aid 30 when the professional is not readily available.

In at least some embodiments, the syringe 40 may couple to hearing device 30 so that when the syringe 40 is rotated about its longitudinal axis, the captured device 30 is rotated along with the syringe 40. For example, the distal tip 41*a* of the syringe 40 and the lateral knob 39 of the hearing device 30 may have interlocking and/or complementary shapes or interfaces. The captured device 30 may be rotated as such when within the ear canal 10.

Figure 5A:
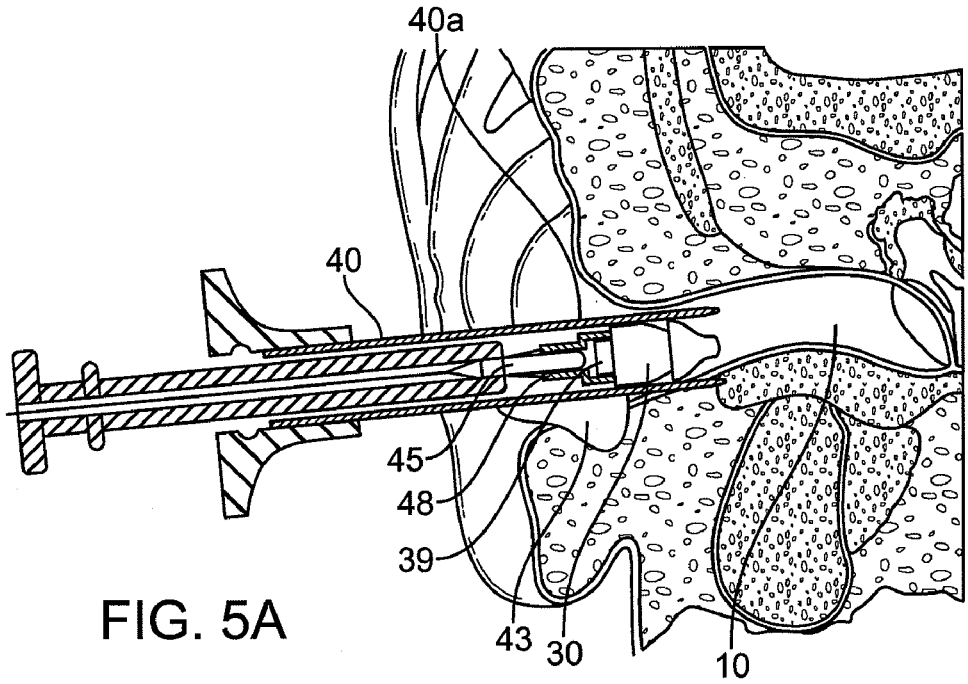
FIGS. 5A to 5C show how the plunger of FIG. 4 can be used to adjust the position of an in-canal hearing device.
Figure 5B:
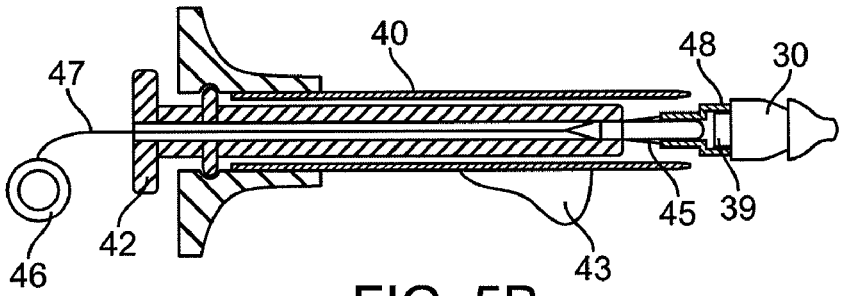
Figure 5C:
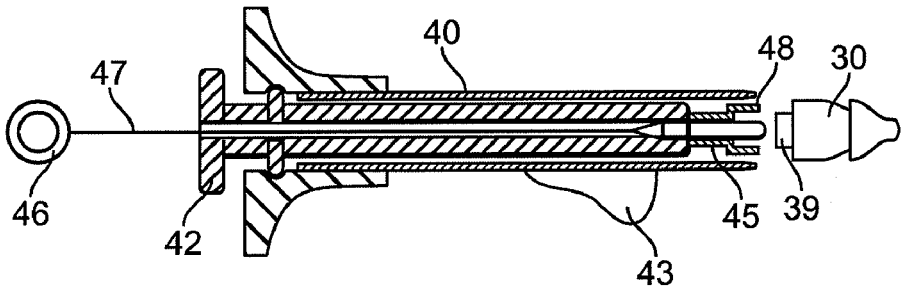

FIGS. 5A to 5C show a method of using the plunger 40 to insert the hearing device 30 into a user's ear canal 10. As shown in FIG. 5A, the distal tip 40*a* of the plunger 40 is inserted into the ear canal 10. Within the plunger 40 is the captured hearing device 30. The side extension 43 abuts the wall of the conchal bowl and limits the medial advancement of plunger 40. The plunger 40 may be rotated about its longitudinal axis to adjust the orientation of hearing device 30. As shown in FIG. 5B, pressing the plunger will advance the captured hearing device 30 into the ear canal. The hearing device 30 will typically be advanced so that the captured hearing device 30 is at an optimal medial-lateral position in the ear canal, e.g., so that the hearing device 30 is positioned at bony junction 19 as previously described. The plunger 30 may also advance or retract the hearing device 30 to other positions within the ear canal 10. As shown in FIG. 5C, ring 46 is then pulled, releasing the captured hearing device 30.

Figure 6:
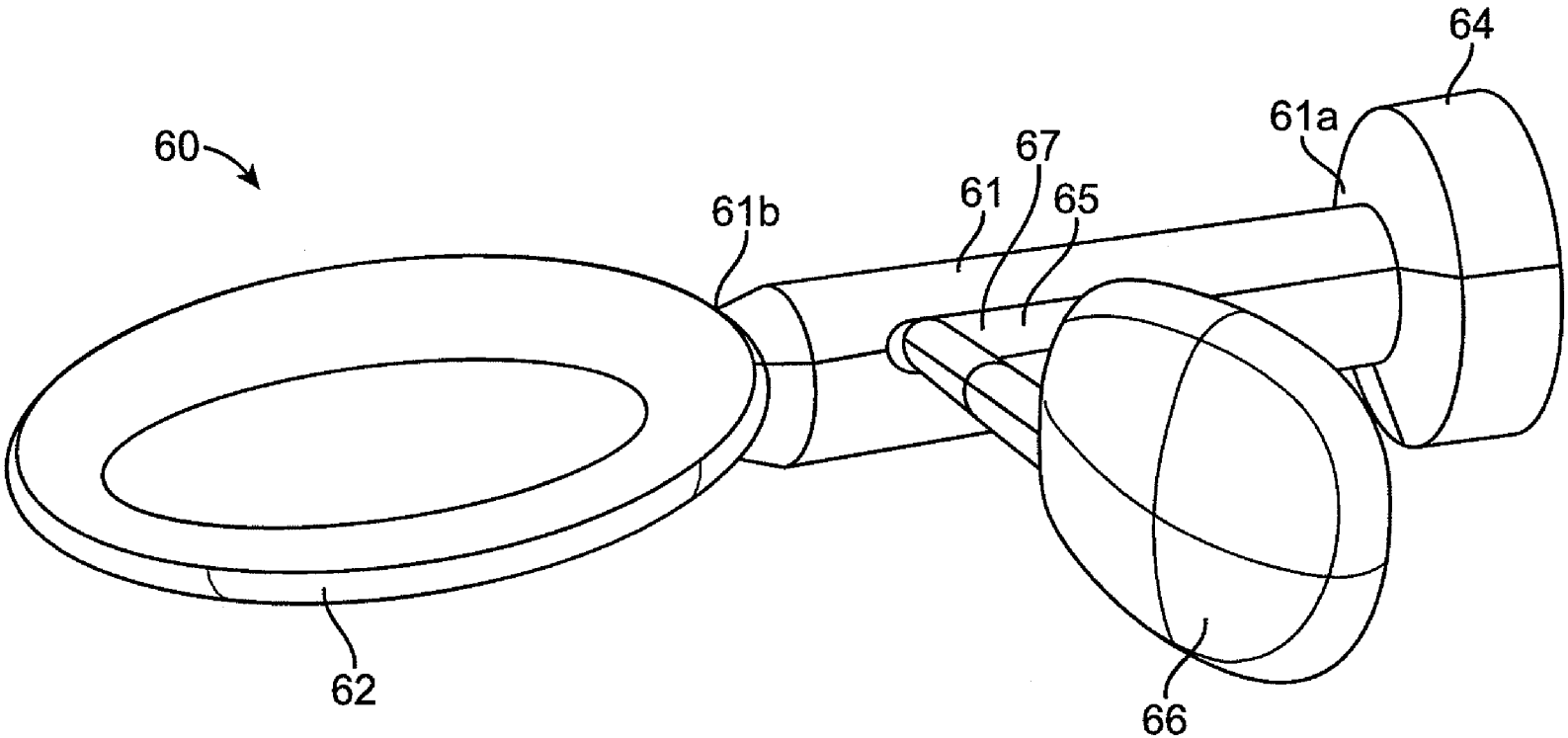
FIG. 6 shows a finger loop tool adapted for positioning an in-canal hearing device.

Referring now to FIG. 6, another embodiment of the invention provides a finger loop tool 60 for inserting and/or positioning the in-canal hearing device 30 within a user's ear canal. Finger loop tool 60 comprises a central tube 61 having a distal end 61*a* and a proximal end 61*b*. A distal finger loop 62 is coupled to the proximal end 61*b* of the central tube 61. A distal cap 64 is coupled to the proximal end 61*a* of the central tube 61. The cap 64 is adapted to capture the lateral knob 39 of the hearing device 30. Finger loop tool 60 further comprises a shaft 65 disposed within tube 61 and a cheek rest 66 coupled to shaft 65 and extending radially out of a side aperture 67 of tube 61. The shaft 65 is axially moveable within tube 61 and may be spring-loaded within tube 61. The tube 61 and the shaft 65 are typically flexible, particularly in their distal ends. When finger loop tool 60 is inserted into the ear canal 10, this flexibility allows the tool 60 to accommodate for the tortuous passage of the ear canal 10 and minimize injurious contact with the walls of the ear canal. In at least some embodiments, the finger loop tool 60 may couple to hearing device 30 so that when the finger loop tool 60 is rotated about its longitudinal axis, the captured device 30 is rotated along with finger loop tool 60. For example, the distal cap 64 of the finger loop tool 60 and the lateral knob 39 of the hearing device 30 may have interlocking and/or complementary shapes or interfaces. The captured device 30 may be rotated as such when within the ear canal 10.

Figure 6B:
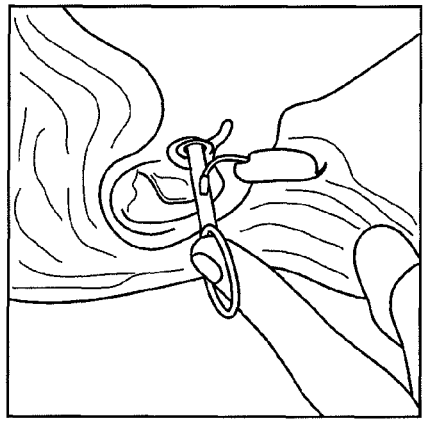
FIGS. 6A to 6D show how the finger loop tool of FIG. 6 can be used to adjust the position of an in-canal hearing device.
Figure 6D:
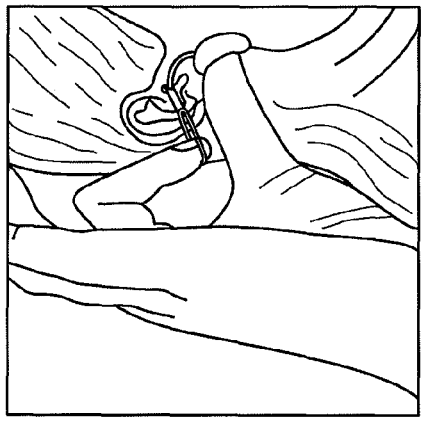
Figure 6A:
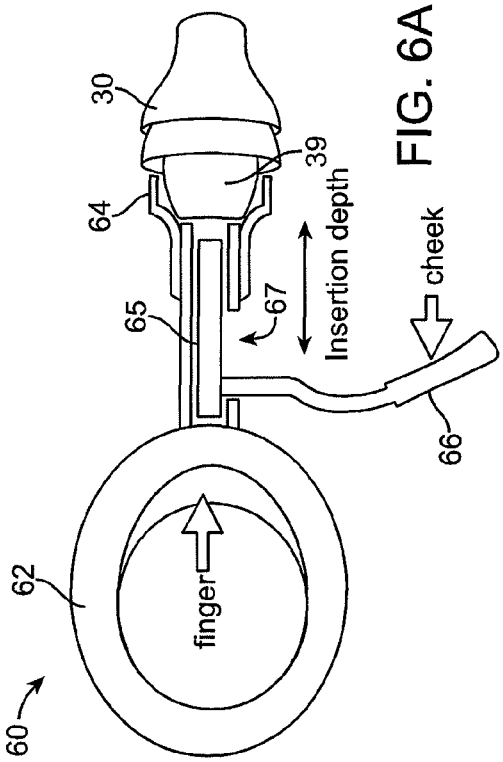
Figure 6C:
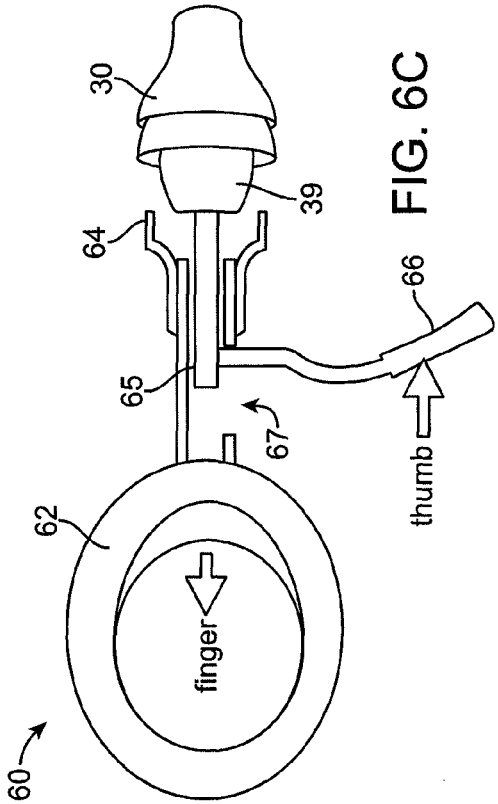

FIGS. 6A to 6D show a method of using the finger loop tool 60 to insert a hearing device 30 within a user's ear canal. As shown in FIG. 6A, finger loop tool 60 has captured the hearing device 30. In particular, the distal cap 64 has captured the lateral knob 39 of the hearing device 30, with the distal end of the shaft 65 abutting the lateral knob 39. Generally, the axial position of the cheek rest 66 relative to the distal cap 64 determines the maximum insertion depth of the hearing device 30. As shown in FIG. 6B, a user loops his or her finger on finger loop 62 and inserts the distal end of the finger loop tool 60 into his or her ear canal. The finger loop tool 60 will typically be inserted into the ear canal until the cheek rest 66 rest against the user's cheek. Prior to insertion of the finger loop tool 60 into the ear canal, the finger loop tool 60 can be rotated about its longitudinal axis to adjust the orientation of captured hearing device 30 as described above. As shown in FIGS. 6C and 6D, the user can then use his or her finger to proximally retract finger loop 61 and another finger to maintain the position of cheek rest 66. The proximal retraction of finger loop 61 while maintaining the position of cheek rest 66 moves the shaft 65 and tube 61 relative to one another. The distal cap 64 is retracted while the distal end of shaft 65 remains abutting the lateral knob 39 of the hearing device 30, thus releasing hearing device 30 into the ear canal.

Figure 6E:
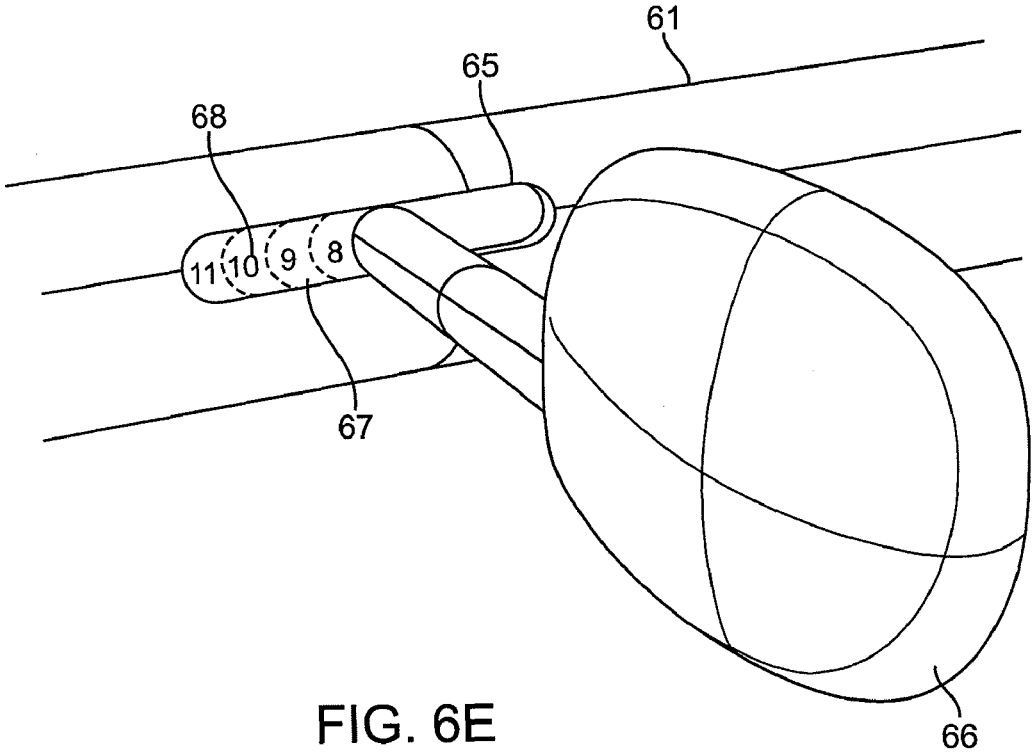
FIG. 6E is a magnified view of a cheek rest of the finger loop tool of FIG. 6.

FIG. 6E is a magnified view of the cheek rest 66 of the finger loop tool 60. The finger loop tool 60 may comprise a sliding slot 68 which abuts the proximal end of shaft 65. The sliding slot 68 may be punched in a distal or proximal direction to adjust its position and the size of the aperture 67. Thus, the position of the cheek rest 66 and thus also the maximum depth of insertion of hearing device 30 can be adjusted. For example, a professional may measure the ideal ear canal insertion depth of the in-canal hearing aid 30 and set the position of the sliding slot 68 accordingly. A customized finger loop tool 60 is thus provided to a user for use by the user to adjust the medial-lateral position of his or her hearing aid 30 when the professional is not readily available.

Figure 7:
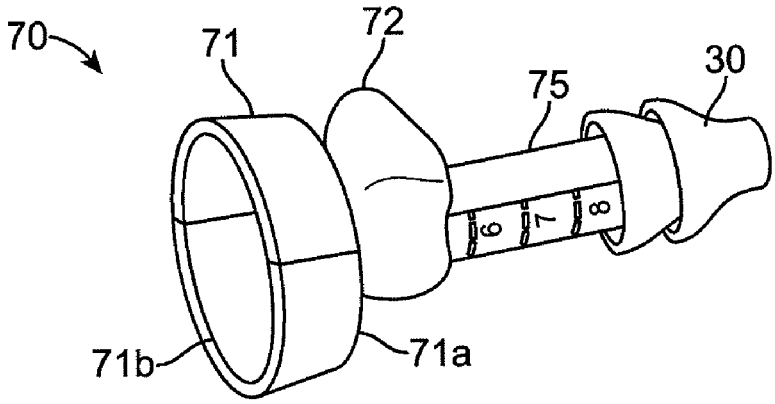
FIG. 7 is a perspective view of a thimble adapted for positioning an in-canal hearing device.

Referring now to FIG. 7, another embodiment of the invention provides a thimble tool 70 adapted for positioning the in-canal hearing device 30 within an ear canal 10. The thimble tool 70 comprises a thimble base 71 and a shaft 75. The thimble base 71 has a closed distal end 71*a* and an open proximal end 71*b*. To use the thimble tool 70, a user's finger is typically inserted into open proximal end 71*b*. The closed distal end 71*b* of the thimble tool 70 is coupled to the proximal end of shaft 75.

Figure 7A:
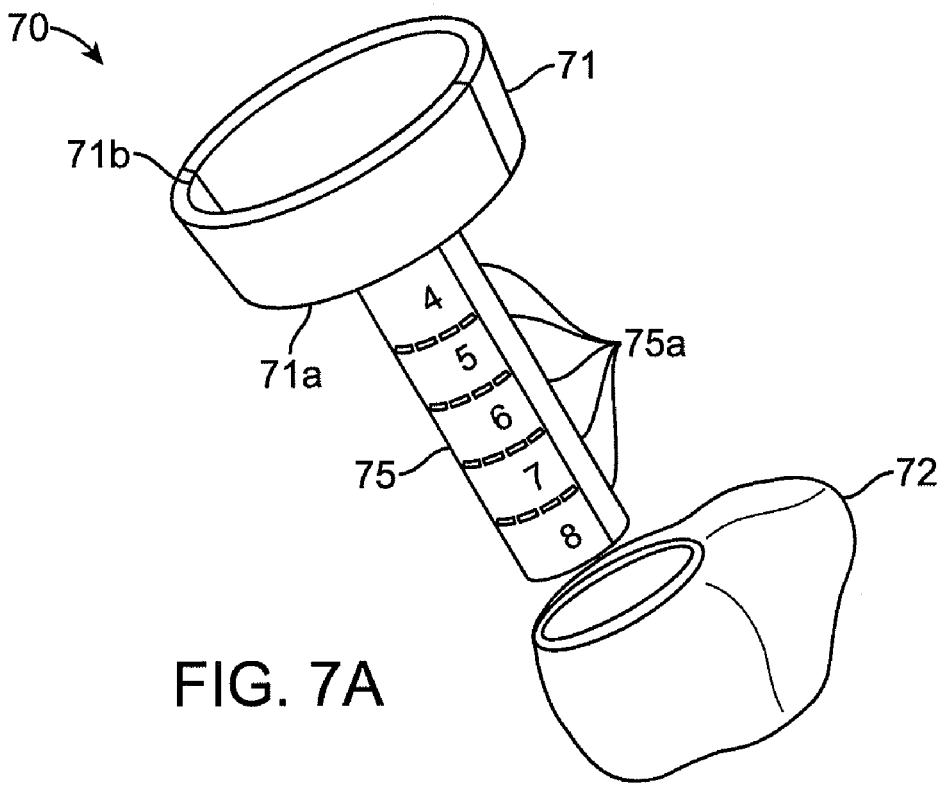
FIG. 7A is an exploded view of the thimble of FIG. 7.

The thimble tool 70 may further comprise a mold 72 couplable to the proximal end of shaft 75 and the distal end 71*b* of thimble tool 70. As shown in FIG. 7A, the mold 72 will typically be removable therefrom. The mold 72 typically conformed to fit with the conchal bowl of the user and may be made of a material comprising at least one of silicone, clay, quick-dry gel, or similar materials.

The shaft 75 will typically be flexible. When the thimble tool 70 is inserted into the ear canal 10, this flexibility allows the thimble tool 70 to accommodate for the tortuous passageway of the ear canal 10 and to minimize injurious contact with the walls of the ear canal 10. The shaft 75 can be adjusted in length. The shaft 75 may comprise a plurality of shaft portions 75*a* which are removable from each other. The distal end of the shaft 75 can be coupled to the hearing aid 30.

In at least some embodiments, the thimble tool 70 may couple to hearing device 30 so that when the thimble tool 70 is rotated about its longitudinal axis, the captured device 30 is rotated along with the thimble tool 70. For example, the distal end 71*a* of the thimble tool 70 and the lateral knob 39 of the hearing device 30 may have interlocking and/or complementary shapes or interfaces. The captured device 30 may be rotated as such when within the ear canal 10.

Figure 7B:
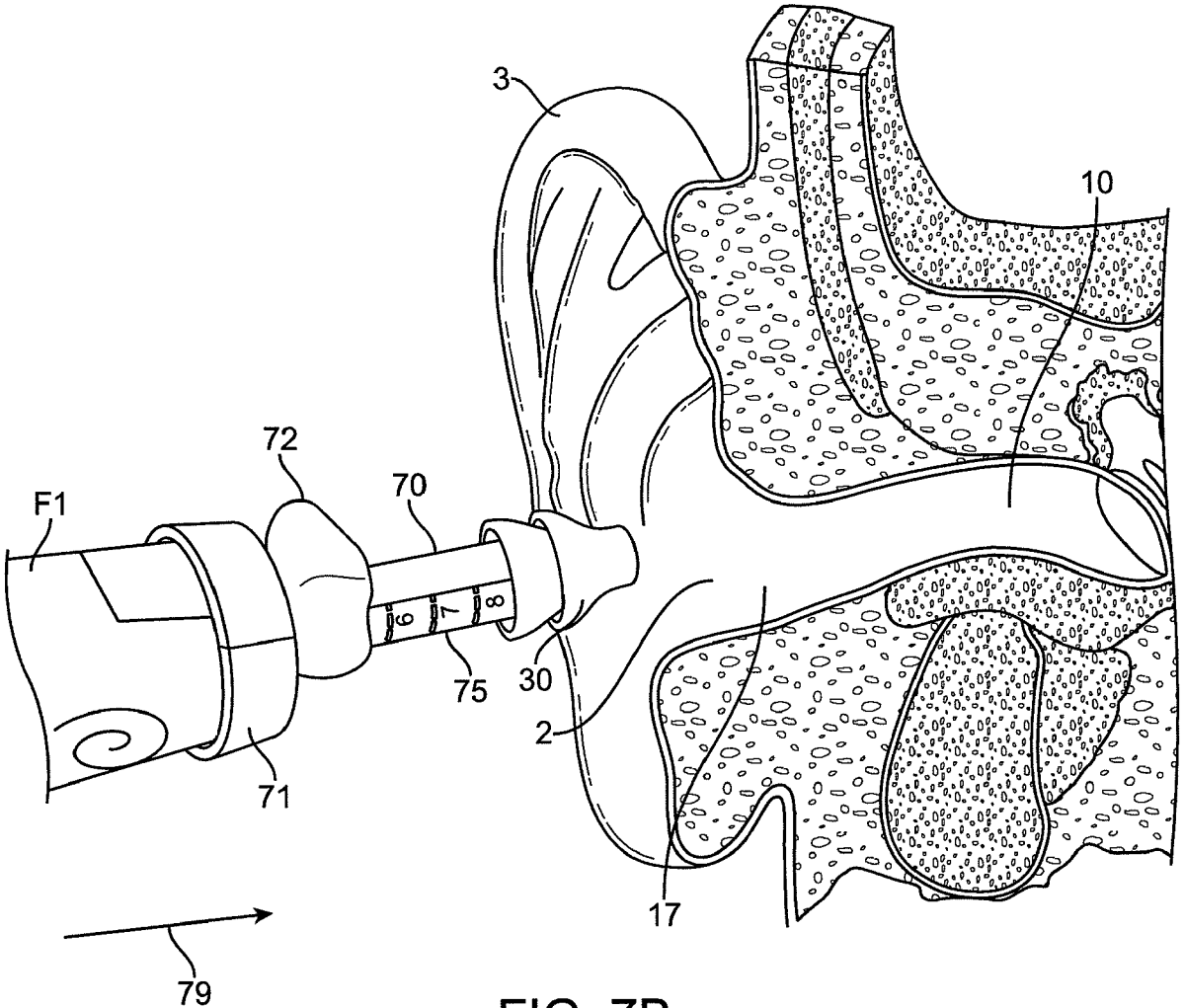
FIG. 7B shows the thimble of FIG. 7 being used to insert an in-canal hearing device into the ear canal.

Referring now to FIG. 7B, embodiments of the invention provide a method of using the thimble tool 70 to insert the hearing aid 30 within the ear canal 10. The hearing aid 30 is placed on the distal end of the shaft 75. The user then places his or her finger FI into the thimble 71 and positions the thimble tool 70 so that the shaft 75 enters the ear canal 10. The shaft 75 is advanced medially into the ear canal 10, i.e., in the direction indicated by arrow 79, until further medial advancement is limited by the mold 72, thus positioning the hearing aid 30 at a desired depth within the ear canal 10. This desired depth is determined by the distance between the distal tip of shaft 75 and the mold 72. As previously described, the length of shaft 75 can be adjusted, thus the desired depth of insertion of the hearing aid 30 using the thimble tool 70 can be customized for an individual user. For example, a professional may measure an optimum ear canal insertion depth of the in-canal hearing aid 30 and set the length of shaft 75 accordingly. A customized thimble tool 75 is thus provided to a user for use to adjust the medial-lateral position of his or her hearing aid 30 when the professional is not readily available.

Embodiments of the invention therefore also provide a method for assembling thimble tool 70 and customizing it for an individual user. The mold 72 is shaped to fit the conchal bowl of a user. The distance between the lateral knob 39 of the hearing aid 30 and the conchal bowl is measured. The length of shaft 75 is adjusted based on this measured distance. The thimble 71, the customized mold 72, and the customized shaft 75 are then coupled to each other.

Figure 8C:
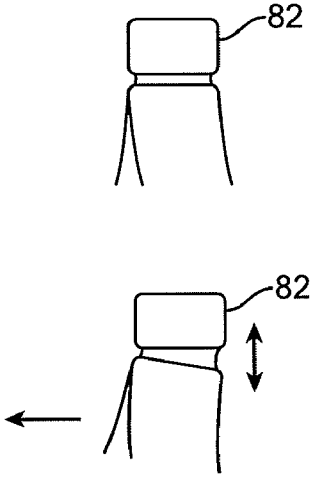
FIGS. 8A to 8C show a pair of reverse-action tweezers adapted for positioning an in-canal hearing device.
Figure 8A:
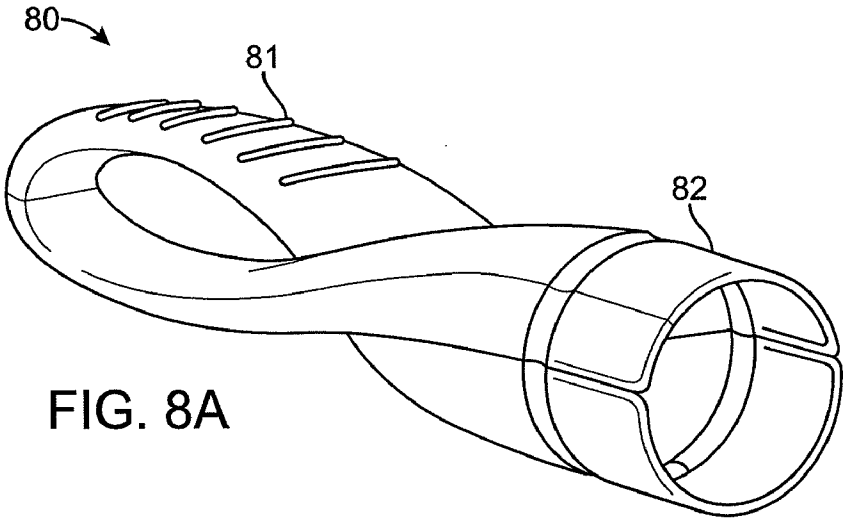
Figure 8B:
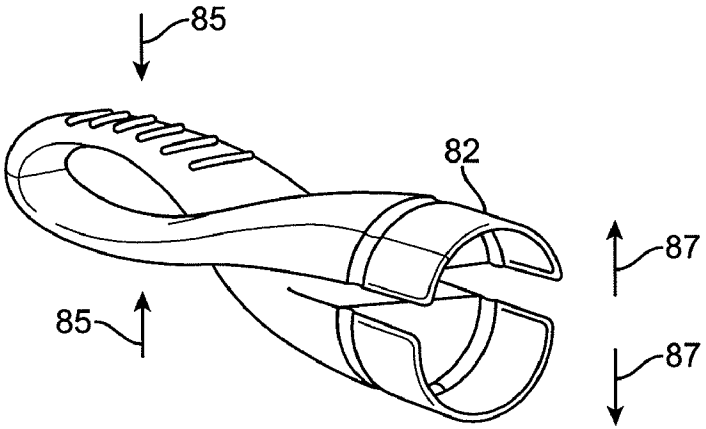

FIGS. 8A to 8C show a pair of reverse-action tweezers 80 adapted for positioning an in-canal hearing device 30. The pair of reverse-action tweezers 80 comprises a pressable proximal portion 81 and a distal portion comprising a distal tip 82. The distal tip 82 is adapted to capture the lateral knob 39 of the hearing aid 30. As shown in FIG. 8C, the distal portion 81 can be squeezed (as indicated by arrows 85) to open the distal tip 82 (as indicated by arrows 87). The distal portion 81 may be flexible, the tortuous passageway of the ear canal can be accommodated for and injurious contact with the walls of the ear canal minimized. In at least some embodiments, the pair of tweezers 80 may couple to hearing device 30 so that when the pair of tweezers 80 is rotated about its longitudinal axis, the captured device 30 is rotated along with the pair of tweezers 80. For example, the distal tip 82 of the pair of tweezers 80 and the lateral knob 39 of the hearing device 30 may have interlocking and/or complementary shapes or interfaces. The captured device 30 may be rotated as such when within the ear canal 10.

Figure 9B:
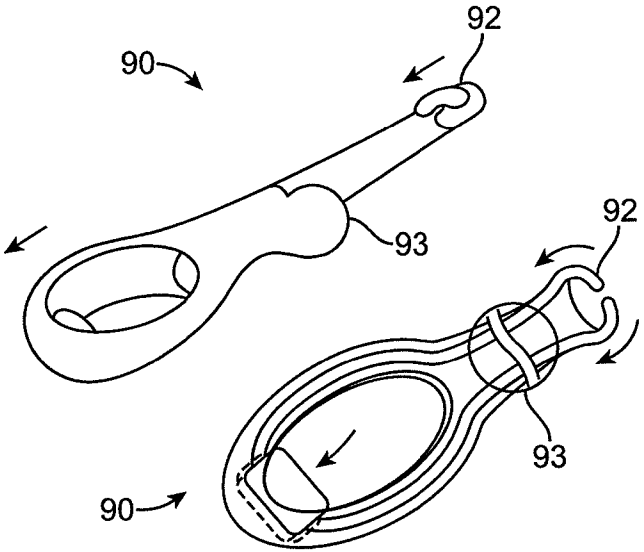
FIGS. 9A and 9B show a paddle tool adapted for positioning an in-canal hearing device.
Figure 9A:
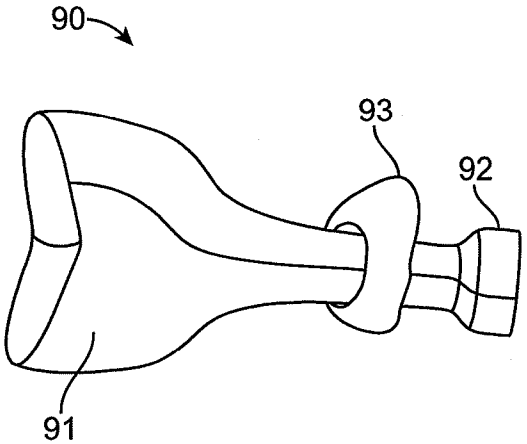

FIGS. 9A and 9B show a paddle tool 90 adapted for positioning the in-canal hearing device 30. The paddle tool 90 comprises a proximal portion 91, a distal portion 92 for capturing the hearing device 30, and a mold 93. The mold 93 limits the depth the paddle tool 90 can be advanced. The paddle tool 90 may comprise internal tendons and can be button activated to toggle the distal portion 92 which can release a captured hearing device 30. The distal portion 92 may be flexible, the tortuous passageway of the ear canal can be accommodated for and injurious contact with the walls of the ear canal minimized. In at least some embodiments, the paddle tool 95 may couple to hearing device 30 so that when paddle tool 90 is rotated about its longitudinal axis, the captured device 30 is rotated along with the paddle tool 90. For example, the distal portion 92 of the paddle tool 90 and the lateral knob 39 of the hearing device 30 may have interlocking and/or complementary shapes or interfaces. The captured device 30 may be rotated as such when within the ear canal 10.

Figure 10:
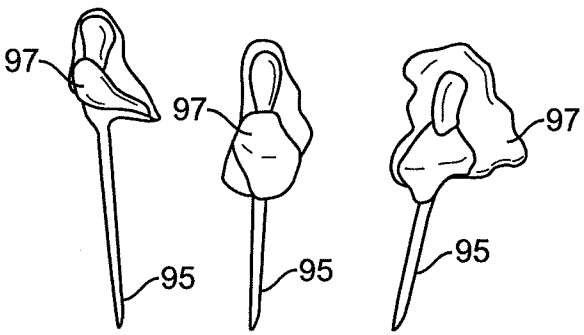
FIG. 10 shows a set of rods adapted for positioning an in-canal hearing device.

FIG. 10 shows a set of rods 95 adapted for positioning an in-canal hearing device 30. Each of the rods 95 may be coupled to a mold 97 which is conformed to the conchal bowl of an individual user. The mold 97 limits the depth to which rod 95 can be inserted into ear canal 10. This depth is typically selected according to the optimum medial-lateral position of the hearing aid 30 and is selected by customizing the position of the mold 97 along a rod 95. A user may place the hearing device 30 on the opening of the ear canal 10 and use a rod 95 to push the it into the ear canal 10 into its optimum position within the ear canal 10. Rods 95 will typically be flexible so that when inserted into the ear canal 10, the tortuous passageway of the ear canal can be accommodated for and injurious contact with the walls of the ear canal minimized. In at least some embodiments, a rod 95 may couple to hearing device 30 so that when rod 95 is rotated about its longitudinal axis, the captured device 30 is rotated along with the rod 95. For example, the distal end of a rod 95 and the lateral knob 39 of the hearing device 30 may have interlocking and/or complementary shapes or interfaces. The captured device 30 may be rotated as such when within the ear canal 10.

The above description of various embodiments of the invention are presented for the purposes of illustration and description. Various alternatives, modifications, additions and substitutions are possible without departing from the scope of the invention, which is limited solely by the claims.

What is claimed is:

1. A tool for adjusting the medial-lateral positioning of a hearing device placed within an ear canal of a user, the tool comprising:

a pressable proximal portion; and a distal portion, with a profile sized for insertion into the ear canal, including distal tip, the distal tip having an expanded state and an unexpanded state and being configured to capture a lateral end of the hearing device when in the unexpanded state and to release the lateral end of the hearing device when in the expanded state, the proximal portion being coupled to the distal portion such that pressing of the proximal portion expands the distal tip to the expanded state.

2. The tool of claim 1, wherein the tool has a longitudinal axis and rotating the tool about the longitudinal axis rotates the captured hearing device.

3. The tool of claim 2, wherein rotating the tool rotates the captured hearing device when the hearing device is captured within the ear canal.

4. The tool of claim 1, wherein the tool comprises a pair of reverse-action tweezers.

5. The tool of claim 1, wherein the distal portion comprises a side extension adapted to engage a wall of a conchal bowl of an ear of the user to limit medial advancement of the tool.

6. The tool of claim 5, wherein the side extension is shaped to conform to the conchal bowl.

7. The tool of claim 1, wherein the distal portion is flexible.

8. A tool for adjusting the medial-lateral positioning of a hearing device placed within an ear canal of a user, the tool comprising:

a pressable proximal portion;

a distal portion having a profile sized for insertion into the ear canal and a distal tip configured to capture a lateral end of the hearing device; and means, coupled to the proximal portion and to the distal portion, for causing the distal tip to release a hearing device captured by the distal tip by expanding the distal tip in response to pressing of the proximal portion.

9. The tool of claim 8, wherein the tool has a longitudinal axis and the distal tip is configured to capture a lateral end of the hearing device such that rotating the tool about the longitudinal axis rotates the captured hearing device.

10. The tool of claim 8, wherein the distal portion comprises a side extension adapted to engage a wall of a conchal bowl of an ear of the user to limit medial advancement of the tool.

11. The tool of claim 10, wherein the side extension is shaped to conform to the conchal bowl.

12. The tool of claim 8, wherein the distal portion is flexible.

* * * * *